US006048229A

United States Patent [19]

Lazaro, Jr.

[11] Patent Number: 6,048,229

[45] Date of Patent: Apr. 11, 2000

[54] ENVIRONMENTALLY RESISTANT EMI RECTANGULAR CONNECTOR HAVING MODULAR AND BAYONET COUPLING PROPERTY

[75] Inventor: Luis J. Lazaro, Jr., Seattle, Wash.

[73] Assignee: The Boeing Company, Seattle, Wash.

[21] Appl. No.: 09/363,199

[22] Filed: Jul. 29, 1999

Related U.S. Application Data

[63] Continuation of application No. 08/960,942, Oct. 30, 1997, abandoned, which is a continuation-in-part of application No. 08/687,082, Jul. 23, 1996, abandoned, which is a continuation-in-part of application No. 08/521,776, Aug. 31, 1995, abandoned, which is a continuation-in-part of application No. 08/435,122, May 5, 1995, abandoned.

[51] Int. Cl.[7] ..... H01R 13/64

[52] U.S. Cl. ..... 439/681; 439/680

[58] Field of Search ..... 439/620, 364, 439/372, 681, 953, 587, 589, 744, 939, 274, 701

[56] References Cited

U.S. PATENT DOCUMENTS

| | | | |
|---|---|---|---|
| 3,477,061 | 11/1969 | Stephenson | 439/589 |
| 3,550,065 | 12/1970 | Phillips | 439/272 |
| 4,229,064 | 10/1980 | Vetter et al. | 439/680 |
| 4,736,999 | 4/1988 | Marks et al. | 439/314 |
| 4,820,204 | 4/1989 | Batty | 439/681 |
| 4,938,718 | 7/1990 | Guendel | 439/680 |
| 5,211,582 | 5/1993 | Morse et al. | 439/589 |
| 5,219,296 | 6/1993 | Nguyen | 439/95 |
| 5,558,533 | 9/1996 | Hashizawa et al. | 439/310 |
| 5,647,766 | 7/1997 | Nguyen | 439/620 |

*Primary Examiner*—Lincoln Donovan
*Assistant Examiner*—Michael C. Zarroli
*Attorney, Agent, or Firm*—Conrad O. Gardner

[57] ABSTRACT

An electrical rectangular connector having an expanded range on the lower limit of the environment resisting wire sealing webs, a dielectric hard face socket insert to detect splayed or bent pin contacts, a controlled configuration on the contact retention clips which provides easy insertion and removal on the contacts. Additionally, the modular insert construction of the connector allows flexibility to the wiring system, meaning, the connector can have a signal, power, coaxial or twinaxial or combination circuitry and also a bayonet coupling mechanism assembly using dowel pins and dual helical ramp grooves to retrin the connector halves in the coupled condition. Consequently, a visual indicator consisting of an arrowhead opposite a marker labeled "HOME" provides assurance on a fully coupled plug and receptacle connector.

18 Claims, 5 Drawing Sheets

Fig. 3.
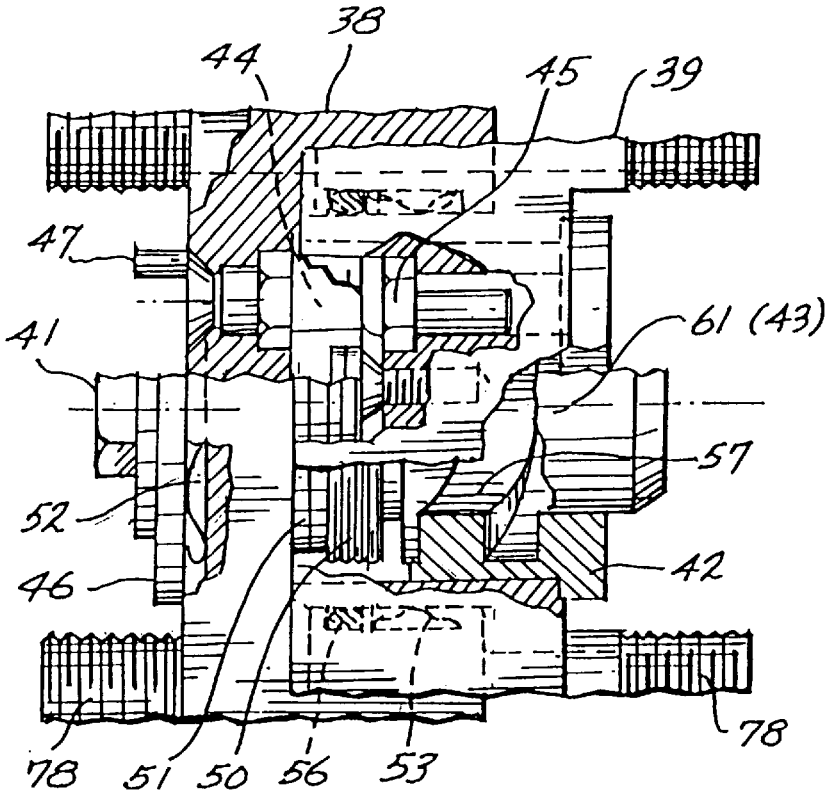
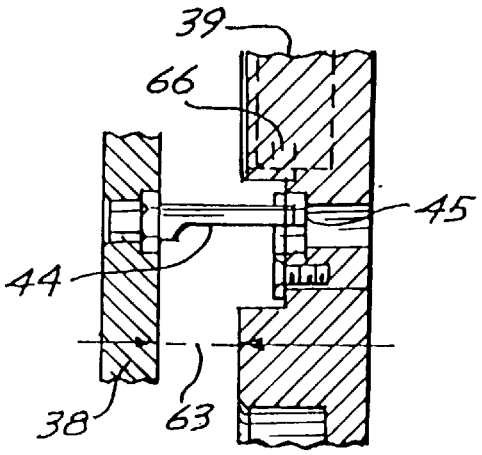
Fig. 5c.
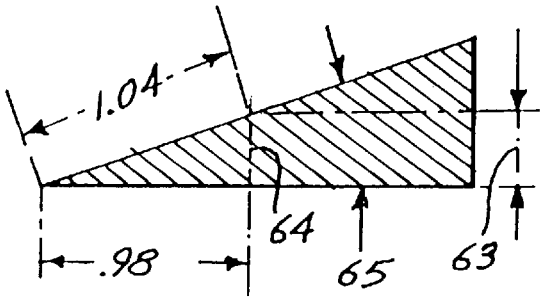
Fig. 5D.

RAMP SURFACE
A
Z
63
53
39
38
73
72
69
52
78
57
61
71
42
45
44
70
6
43
75
67
15
50
47
74
41
51
46

ENVIRONMENTALLY RESISTANT EMI RECTANGULAR CONNECTOR HAVING MODULAR AND BAYONET COUPLING PROPERTY

RELATED APPLICATIONS

This application is a continuation of application Ser. No. 08/960,942, filed Oct. 30, 1997, now abandoned, which was a continuation-in-part of application Ser. No. 08/687,082, filed Jul. 23, 1996, now abandoned, which was a continuation-in-part of application Ser. No. 08/521,776, filed Aug. 31, 1995, now abandoned, which was a continuation-in-part of application Ser. No. 08/435,122 filed May 5, 1995, now abandoned.

SUMMARY OF THE INVENTION

For this illustration but not limited to, the present invention utilizes an ARINC type electrical rectangular connector having an improved environment resisting rubber grommet, a dielectric hard face socket insert, user friendly contact retention clips and a bayonet coupling mechanism using dowel pins and helical ramp grooves to maintain the connector halves in their coupled condition.

It is an object of the present invention to significantly improve and increase reliability on the environment resisting property of the ARINC (rack and panel) rectangular connector.

A further object of the invention is to ensure proper mating or coupling on the electrical pin and socket contacts when splayed or bent contacts are affected.

Another object of the invention is to eliminate manufacturers variation on the construction of the contact retention clips and institute ease of assembly or disassembly on the electrical contacts.

Yet another object of this invention is to significantly lower cost in the assembly of connectors and greatly solidify the interconnection between the plug and receptacle connectors, simply stated, a new integral bayonet coupling mechanism replaces presently used external track mounting or hold down or bulky jackscrew/jackpost coupling mechanisms.

A further object of this invention is the modular construction which allows flexibility to the desired contact density or arrangement such as signal or power or coaxial/twinaxial contact or combination and wiring separation. This configuration is also a space saver.

The present invention provides improved wire sealing webs, provision of a hard dielectric face socket insert to detect splayed or bent electrical contacts, user friendly retention clips which enhance insertion and removal of contacts resulting in elimination of damaged or push back retention clips and locking (dowel) pin in the plug shell designed to engage a double right hand lead thread (ramp groove) in the receptacle shell formed a bayonet coupling assembly on the plug and receptacle connectors. The present invention provides much latitude in the installation of the connectors by reason of the built-in bayonet coupling mechanism, thereby expanding the normal rack and panel installation to areas where circular connectors are now used. It can also be appreciated that once the plug and receptacle rectangular connectors are coupled that they would not become inadvertently uncoupled, yet the connector should permit ready uncoupling when it is desired to separate the plug and receptacle connectors. Consequently, it is within the scope of the present invention to provide a connector that will withstand a high degree of vibration, large shock forces, and appreciable temperature variation. Furthermore, the present invention rectangular connector having modular configuration on the insert module allows interchangeability of pin and socket insert modules on plug and receptacle connectors for rapid and easy assembly and maintenance. By reason of improved electrical characteristics, the mechanical construction is also improved.

BRIEF DESCRIPTION OF THE DRAWINGS

FIG. 3 is a section view on the present invention bayonet coupling mechanism illustrating the locking pin assembly on the plug shell (shaded area) is fully engaged with the helical socket on the receptacle shell (clear area);

FIG. 5C shows engagement as in the case of the prior art on the polarization device upon initial coupling of the plug and receptacle connectors.

FIG. 5D shows configured construction of the bayonet coupling mechanism having double right hand lead thread (ramp groove) illustrating on the coupling load, ramp angle and pull-up distance.

DETAILED DESCRIPTION OF THE INVENTION

Figure 1:
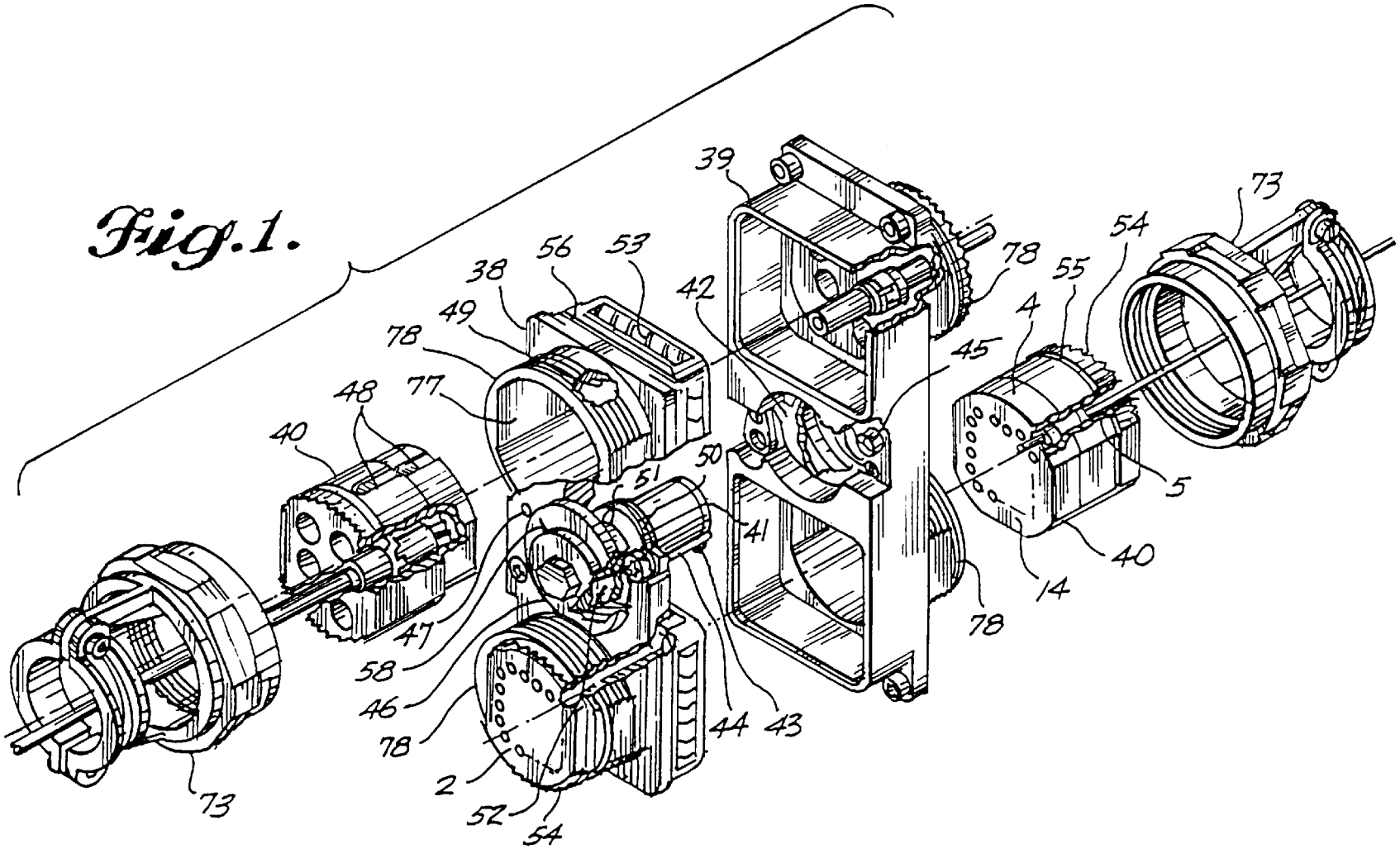
FIG. 1 is an isometric view illustrating the main components of the present embodiment rectangular connector consisting of the plug and receptacle shells, removable insert modules, bayonet coupling mechanism, backshell accessory, etc.

An electrical, rectangular, modular, environment resisting, bayonet coupling connector which is detailed in its entirety from FIG. 1 through FIG. 6. A connector of this type comprises a plug 38 and a receptacle shell 39 having removable insert modules 40 and a bayonet coupling mechanism (no identification given as it consists of several working components which will later be described in detail). An EMI spring 53 (as in the prior art) and an O-ring seal 56, respectively, are provided in a groove around each insert housing on the plug shell 38 to ensure electrical grounding and environmental sealing to the mating receptacle shell 39. The insert module 40 is an assembly containing a rubber grommet 2, a rigid dielectric contact retainer 3, a rubber insert 4 and a metal pressure ring 54. These members are all fixedly configured as shown in FIGS. 2A and 2B such that the rubber grommet 2 is bonded onto the rigid dielectric contact retainer 3 which is bonded onto the rubber insert 4 and a pressure ring 54 provides enclosure to the bonded rubber grommet 2 and the rigid dielectric contact retainer 3. A detailed description of components described and shown in FIGS. 1–5 from my copending U.S. application Ser. No. 08/986,378, relating to the improved environment resistant seal webbing 5, a dielectric hard socket face insert 14, and the user friendly contact retention clips 20 are properties also built onto the present invention rectangular connectors.

FIG. 1 is an isometric view on the present invention highlighting all the components. Although the functionality of its components are not readily apparent at this stage of the description, it can be pointed out that the integral bayonet coupling mechanism on the plug 38 and receptacle 39 shell far exceed in assembly and performance prior art external coupling mechanisms such as hold down clamp or track mounting or bulky jackscrew/jackpost types.

FIGS. 3–6 describe in detail the working mechanism on the present invention bayonet coupling rectangular connectors. Also, included are two polarizing keys 44 and keyways 45 which are similar to prior art. For clarity purposes, FIG. 3 is shown whereby the bayonet coupling components on the plug shell 38 are shaded in contrast to the clear illustration on the components of the receptacle shell 39. FIGS. 4A through 4F further accentuate this illustration. As shown in FIGS. 4A through 4C, the locking pin assembly is installed onto the plug shell 38 and can be described as follows:

a) Insert locking pin 41 onto positioning washer 46.

b) Install wavespring 52 onto locking pin 41.

c) Assemble locking pin 41 through plug shell 38.

d) Install snap ring 51 onto inserted locking pin 41.

e) Insert coil spring 50 onto locking pin 41. Assemble one end of coil spring 50 into hole 74 on plug shell 38 and install other end of coil spring 50 onto hole 75 on locking pin 41.

f) Wind half turn (clockwise) on locking pin 41 to locate and install roll pin 47 onto plug shell 38.

g) Assemble dowel pin 43 onto locking pin 41 using definitive dimension 76. This assembly is critical to the functionality of the locking pin assembly.

Figures 4A, 4B, 4C, 4D, 4E, 4F:
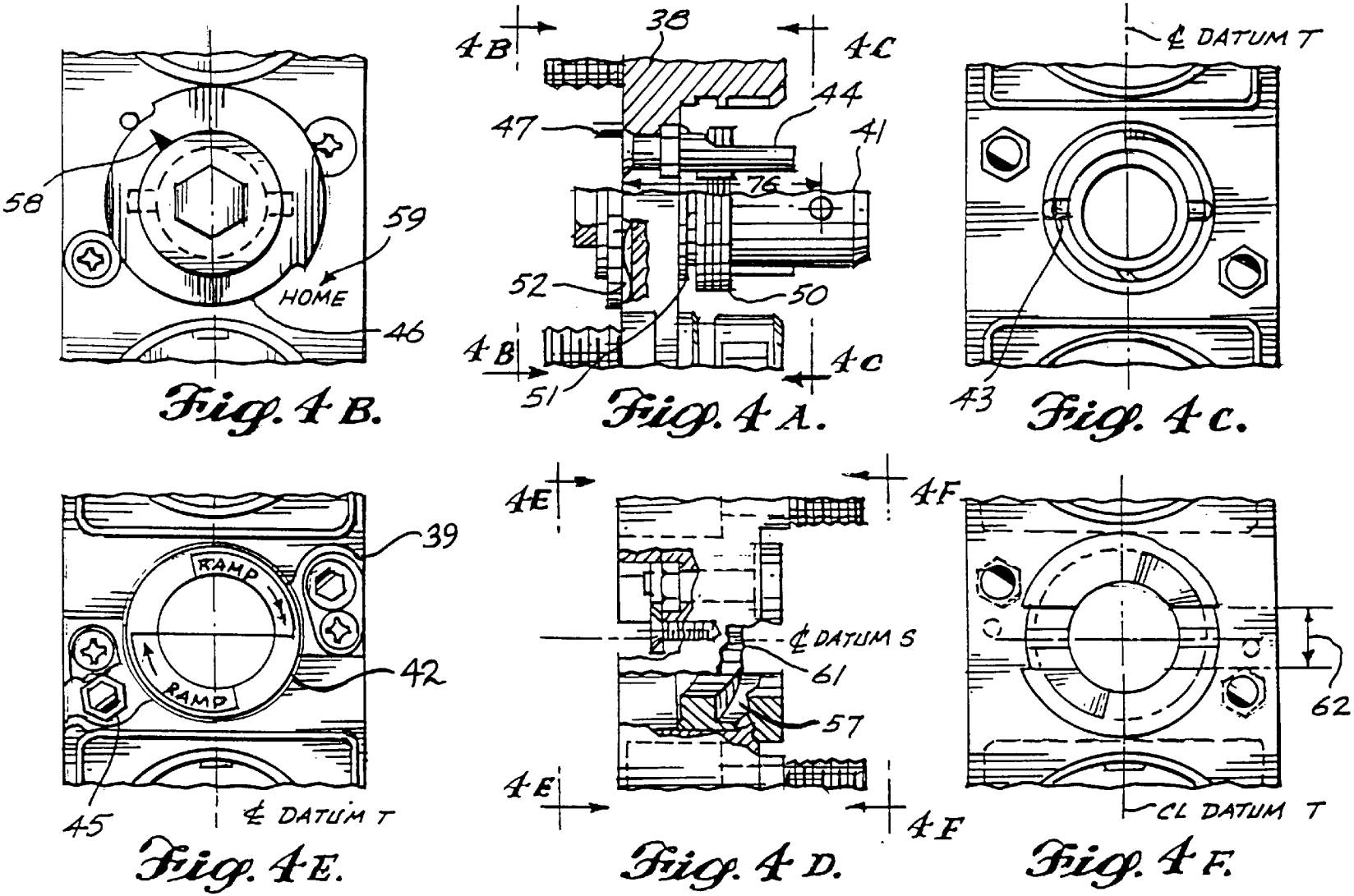
FIGS. 4A–4F are detailed views of the locking pin assembly on the plug shell and the helical socket on the receptacle shell, depicting its component functionality.

Referring now to FIGS. 4D through 4F, it shows configuration and/or construction of the helical socket 42 built with an internal double right hand lead thread (ramp groove) 57 and is installed onto receptacle shell 39. As can be seen and understood, the opening 62 will accept the dowel pin 43 (shown on FIG. 4C) when the plug 38 connector starts to engage the receptacle 39 connector. Further, it will be appreciated that the plug shell 38 movement towards the receptacle shell will cause the dowel pin 43 to bottom against the helical ramp groove 57 thereby prohibiting any further advancement. This condition will enable the assembler to realize the coupling action between the plug 38 and receptacle 39 connectors shall be completed with a half turn on the locking pin 41.

Figures 5A, 5B, 6, 6A, 6B:
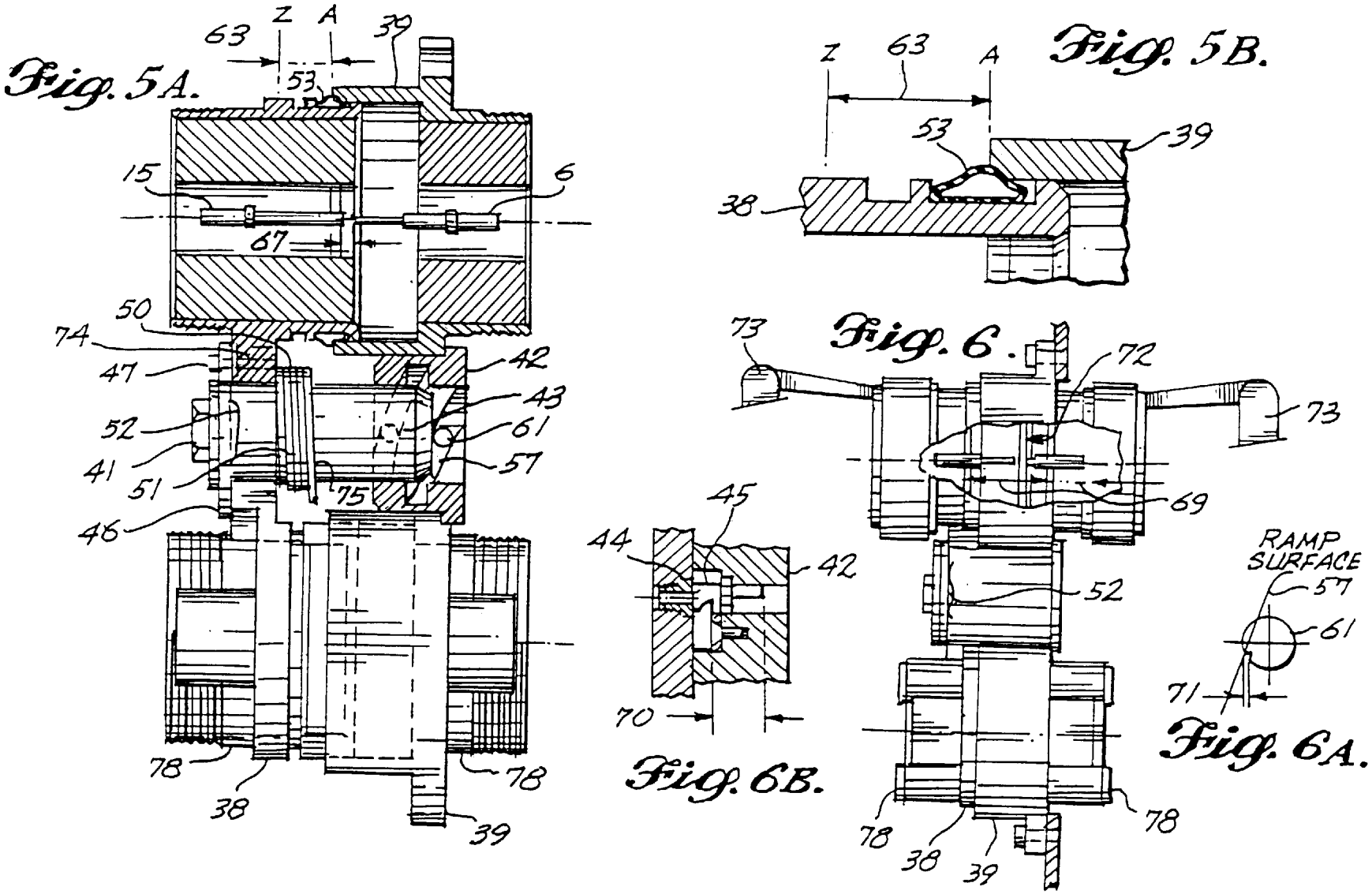
FIG. 5A is a side view of the plug and receptacle connectors illustrating assembly on the present embodiment invention for the purpose of defining critical components configuration and its relationship to achieve connector functionality. Three views are included and discussed below.
FIG. 5B shows initial engagement between the plug and receptacle connectors focusing on the "pull-up" distance towards full coupling on the connectors.
FIG. 6 is a side view of a fully coupled plug and receptacle connectors depicting full engagement on the pin and socket electrical contact and polarizing keys and keyways. Also, shown in FIGS. 6A–6B is the dimensional relationship between the detent hole and the double right hand lead thread for the purpose of establishing true position on the (bayonet) dowel pin relative to the ramp detent hole.

Describing now the bayonet coupling assembly between the plug 38 and receptacle 39 connectors, it will be noted as shown on FIGS. 5A and 5C, respectively, that for this illustration, but not limited to, a ninety-thousands of an inch 67 gap or non-engagement between the electrical pin 6 and socket 15 contacts and a tenth-thousands of an inch 66 engagement on the polarizing keys 44 and keyways 45 exist. This arrangement is necessary for two reasons: a) the initial coupling forces between the plug 38 and receptacle 39 connectors will be at its minimum thereby lessening the potential of misalignment, and b) ensure proper grounding between the plug 38 and receptacle 39 connectors. The described condition is all realized by virtue of positioning the dowel pin 43 at the start of the helical ramp grooves 57 during initial engagement or coupling on the plug 38 and receptacle 39 connectors. It is then by turning the hex head of the locking pin 41 that it will cause the dowel pin 43 to traverse the approximately twenty degree 65 ramp pulling in seventy pounds 64 of engagement force for a final coupling distance of three hundred forty thousands of an inch 63 as shown in FIG. 5D. As can be seen on FIGS. 6A–6B, the coupling action described moved the dowel pin 43 to enter the detent hole 61 located on the closed ends of the helical ramp grooves 57. Performing a very important role in maintaining the dowel pin 43 to be fully seated in the detent hole 61 is a wavespring 52 under compression due to its interfering relationship between the positioning washer 46 and plug 38 connector shell. At this point, the plug 38 and receptacle 39 connectors are fully coupled as evidenced by the electrical engagement 69 and 70, respectively, between the electrical pin 6 and socket 15 contacts and polarizing keys 44 and keyways 45. Furthermore, it can be understood from FIG. 4B that the indicator arrowhead 58 on the positioning washer 46 is pointing towards "HOME" 59. It is equally important to appreciate that the ten thousandth of an inch 71 engagement between the dowel pin 43 and detent hole 61 allows minimal amount of effort in the uncoupling or disconnecting of the plug 38 from the receptacle 39 connector.

When uncoupling or disconnecting the plug 38 and receptacle 39 connectors, a reverse rotation on the hex head of the locking pin 41 forces the partially received dowel pin 43 out of the detent hole 61 causing the interfacial seal compression 72 between the mating insert modules 40 to be released thereby separating the plug 38 from the receptacle 39 connector. It will also be recognized that the separation described will cause the snap ring 51 to collide against the plug 38 connector wall which will add to the separation forces during the uncoupling of the connectors.

Figure 2A:
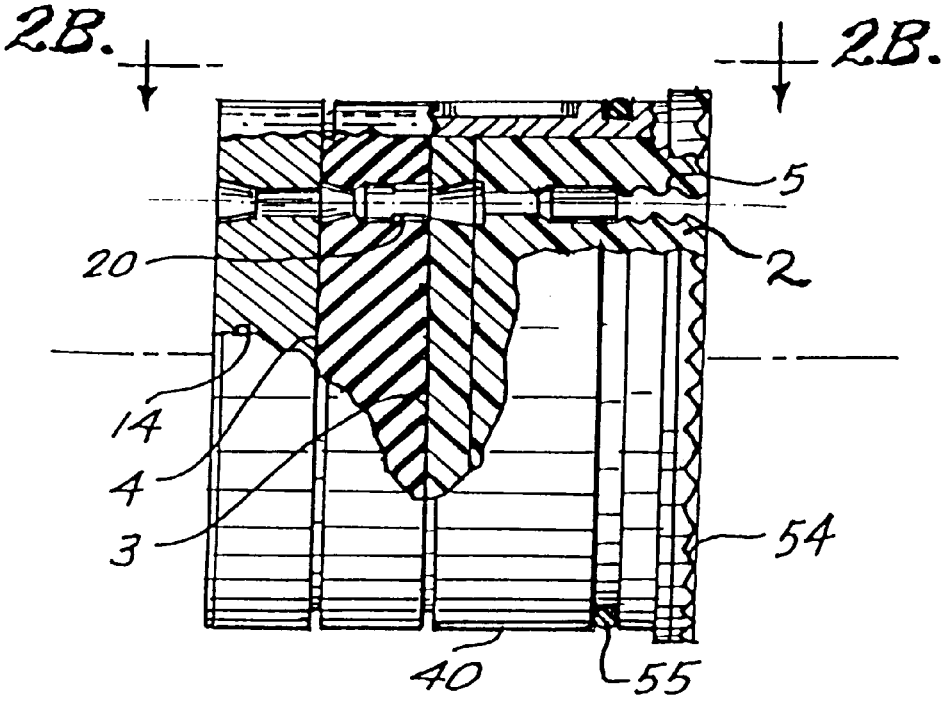
FIG. 2A is a side view of the removable insert module its main components consisting of: a rubber grommet depicting its environment resisting attributes, a rigid dielectric having user friendly contact retention clip, and a rubber insert having a dielectric (hard) face. The members are bonded to form an assembly and a pressure ring provides enclosure to the assembly.
Figure 2B:
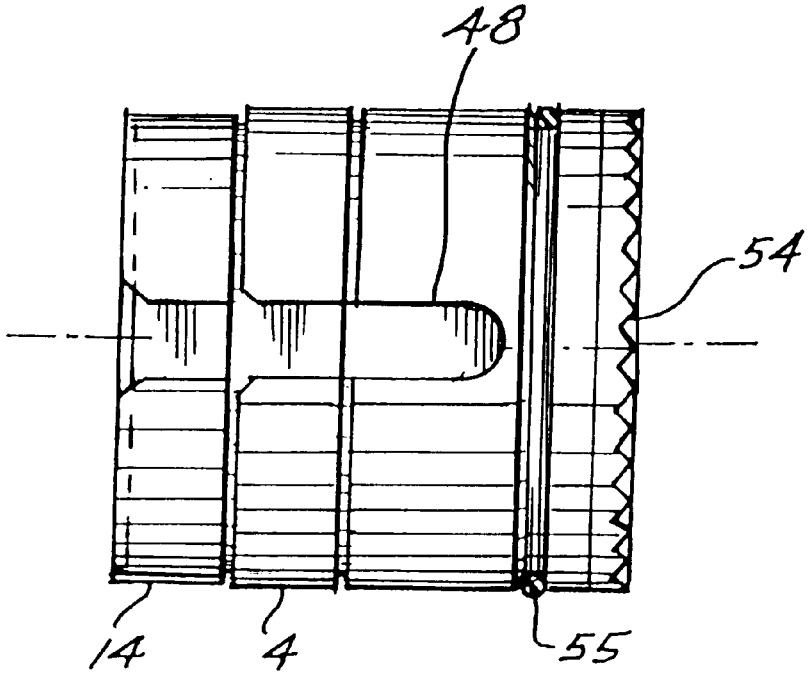
FIG. 2B is a view of the side view of the removable insert module for the purpose of illustrating the keyway along the full length on the insert module.

Another feature of the invention is the removable insert module 40 as shown in FIGS. 2A and 2B. As described earlier, the insert module 40 consisting of a rubber grommet 2 bonded onto a rigid dielectric contact retainer 3 which is bonded onto the rubber insert 4 have all of the components and attributes as described, detailed and shown in FIGS. 1–5 of my copending U.S. application Ser. No. 08/986,378, incorporated herein by reference. Additional components on the insert module 40 are a pressure ring 54 which is fixedly retained the bonded rubber grommet 2 and rigid dielectric contact retainer 3 and an O-ring seal 55 that is positioned in a groove around the pressure ring 54 housing to provide environmental sealing on the insert module 40. A keyway 48 is built onto the pressure ring 54 and rubber insert 4. The keyway 48 is interengageable with a key 49 on the plug 38 and receptacle 39 connector shells for ease of assembly when loading insert module 40 into the insert module cavity 77 on the plug 38 and receptacle 39 connector shell. The backshell 73 retains and maintains the insert module 40 in a bottoming position inside the insert module cavity 77. Performing a very important role in the practicing of this invention is the insert module 40 configuration which can be signal, power, coaxial/twinaxial or combinations. This embodiment property provides wiring flexibility and lower assembly and maintenance cost on the ARINC type rectangular connectors installation.

What is claimed is:

1. An electrical rectangular connector comprising first and second components, each having interengageable contact means, coupling means for advancing said first component with respect to said second component to abut a portion of said second component and to cause engagement of said contact means;

means associated with said first and second components adapted for cooperation in connection with an insert module;

a locking pin assembly interposed between a portion of said coupling means and another portion of said first component which said locking pin assembly means advances to cause engagement on said second component;

a helical socket assembly interposed between a portion of said coupling means and another portion of said second component which said helical socket assembly means engages said first component.

2. The electrical connector defined in claim 1, further including an alignment key disposed at the rear end of an insert module cavity of said first and second component formed thereon projecting radially into a longitudinally directed keyway formed in the exterior of said insert module cavity thereby allowing for their axial engagement and disengagement while preventing their rotation relative to each other.

3. The electrical connector of claim 1, including a deformable O-ring seal positioned around said insert module thereby producing a fluid tight environment on assembly to the cavity of said insert module.

4. The electrical connector of claim 1 wherein said coupling means is rotatable to advance said first component with respect to said second component, said first component including a locking pin rotatable with said coupling means and having an axially directed dowel pin therein shiftable into a detent hole of said helical socket mounted on said second component when said first and second components are fully coupled together.

5. The electrical connector of claim 4 wherein said portion of said coupling means includes a snap ring and coil spring rotatable with both said coupling means and said locking pin, a positioning washer rotatable with said locking pin, and a deformable wavespring engageable by said positioning washer to cause deflection of said wavespring thereby producing a coupling of said first and second components.

6. The electrical connector of claim 4 wherein said positioning washer includes a visual indicator arrowhead designating full coupling on said first and second components.

7. The electrical connector of claim 4 wherein said portion of said coupling means includes said helical socket having internal double right hand lead thread or ramp grooves with said detent hole located at the closed end of said ramp groove receiving said dowel pin so as to provide a bayonet coupling means.

8. The electrical connectors of claim 4 wherein said dowel pin is directly positioned on the open end of said helical ramp groove, and, advancement of said first component onto second component is limited as said dowel pin bottoms against a portion of said helical ramp groove causing said locking pin to complete full coupling on said first and second components.

9. The electrical connector of claim 4 wherein said first and second components each have interengageable contact means; coupling means for advancing said first component with respect to said second component thereby causing a portion of said first components to abut a portion of said second component and to cause engagement of said respective contact means.

10. The electrical connector of claim 4 wherein a deformable O-ring seal mounted around said insert module of said first component produces a fluid tight environment on assembly to said second component.

11. An electrical rectangular connector comprising first and second components, each having interengageable contact means; coupling means for advancing said first component to abut a portion of said second component and to cause engagement of said respective interchangeable contact means and, wavespring means interposed between a portion of said coupling means and another portion of said first component which wavespring means is deflected by a decrease in the distance between said portions and said first mentioned portions abuting each other and wherein, said wavespring means is preloaded.

12. The electrical rectangular connector defined in claim 11 including detent means for assisting said wavespring in the retention of said components in their coupled relationship.

13. The electrical connector defined in claim 12 wherein said detent means includes a dowel pin shiftable into a retentive position.

14. A bayonet coupling connector comprising in combination:

a plug shell (38);

a receptacle shell (39) having removable insert modules (40) and a bayonet coupling mechanism;

a spring (53) and an O-ring seal (56) disposed in a groove around each insert housing on plug shell (38) thereby providing electronic grounding and environmental sealing to mating receptacle shell (39);

and wherein said insert module (40) comprises an assembly including a rubber grommet (2), a rigid dielectric contact retainer (3), a rubber insert (4), and a metal pressure ring (54);

said rubber grommet (2) bonded onto said rigid dielectric contact retainer (3), said dielectric contact retainer (3) bonded onto said rubber insert (4), and said metal pressure ring (54) providing enclosure of said bonded rubber grommet (2) and said rigid dielectric contact retainer ring (3).

15. The method of installing a locking pin assembly onto a plug shell (39) comprising the steps of:

inserting a locking pin (42) onto a positioning washer **(4*b*)**;

installing a wavespring (52) onto the locking pin (41);

assembling the locking pin (41) through plug shell (38);

inserting a snap ring (51) onto inserted locking pin (41);

inserting a coil spring (50) onto locking pin (41);

assembling one end of coil spring (50) into a hole (74) on plug shell (38) and installing a further end of coil spring (50) into a hole (75) on locking pin (41);

winding a half turn in the clockwise direction on locking pin (41) to locate and install a roll pin (47) onto plug shell (38); and then, assembling a dowel pin (43) onto locking pin (41) utilizing a definitive dimension (76).

16. In the method of installing a helical rocket (42) having a ramp groove (57) onto a receptacle shell (39):

causing a plug shell (38) to engage the receptacle shell (39) thereby causing an opening (62) to accept a dowel pin (43) when plug shell (38) begins to engage receptacle shell (39), and further causing the dowel pin (43) to bottom against the helical ramp groove (57) thereby preventing further advancement; and, wherein coupling action between plug shell (38) and receptacle shell (39) is completed with a half turn on locking pin (41).

17. In the method of uncoupling plug shell (38) and receptacle shell (39):

providing reverse rotation on the hex head of a locking pin (41) thereby forcing a partially received dowel pin (43) out of a detent hole (61) causing interfacial seal compression (72) between the mating insert modules (40) to be released thereby separating plug shell (38) from receptacle shell (39) further causing a snap ring (51) to impact against the plug shell (38) wall causing added separation forces during uncoupling of connectors.

18. An insert module (40) comprising in combination:

a rubber grommet (2) bonded onto a rigid dielectric contact retainer (3), said rigid dielectric contact retainer (3) bonded onto a rubber insert (4);

said insert module (40 further including a pressure ring (54) and an O-ring seal (55) disposed in a groove around the pressure ring (54) housing thereby providing environmental sealing on said insert module (40);

a keyway (48) disposed on said pressure ring (54) and a rubber insert (4);

said keyway (48) interengageable with a key (49) on a plug (38) and receptacle (39) connector shells facilitating assembly when loading said insert module (40) into an insert module cavity (77) on said plug (38) and said receptacle connector (39); and, a backshell (73) for retaining and maintaining said insert module (40) in a bottoming position inside said insert module cavity (77).

* * * * *